US006273354B1

(12) United States Patent
Kovacik et al.

(10) Patent No.: US 6,273,354 B1
(45) Date of Patent: Aug. 14, 2001

(54) RETRACTING EXTENSION CORD REEL

(75) Inventors: James D. Kovacik, Brecksville; Paul S. Blanch, Broadview Heights; Joseph J. Smith, Wooster, all of OH (US)

(73) Assignee: Alert Stamping & MFG. Co., Inc., Bedford Hts., OH (US)

( * ) Notice: Subject to any disclaimer, the term of this patent is extended or adjusted under 35 U.S.C. 154(b) by 0 days.

(21) Appl. No.: 09/542,448

(22) Filed: Apr. 4, 2000

Related U.S. Application Data

(63) Continuation-in-part of application No. 09/325,615, filed on Jun. 3, 1999.

(51) Int. Cl.[7] ..... B65H 75/38
(52) U.S. Cl. ..... 242/404; 191/12.2 R
(58) Field of Search ..... 242/404, 371; 191/12.2 R, 12.4

(56) References Cited

U.S. PATENT DOCUMENTS

| | | | |
|---|---|---|---|
| 3,619,518 | | 11/1971 | Blanch et al. . |
| 3,715,526 | | 2/1973 | Blanch et al. . |
| 3,808,382 | | 4/1974 | Blanch et al. . |
| 4,008,791 | * | 2/1977 | Shafii-Kahany et al. . |
| 4,138,177 | * | 2/1979 | Van Valer . |
| 4,282,954 | | 8/1981 | Hill . |
| 4,350,830 | | 9/1982 | Kovacik et al. . |
| 4,407,460 | | 10/1983 | Khudaverdian . |
| 4,467,979 | * | 8/1984 | Koehler . |
| 4,520,239 | * | 5/1985 | Schwartz . |
| 4,656,320 | * | 4/1987 | Maddock . |
| 4,725,697 | | 2/1988 | Kovacik et al. . |
| 4,726,538 | | 2/1988 | Kovacik et al. . |
| 5,158,450 | | 10/1992 | Horita et al. . |
| 5,209,420 | | 5/1993 | Simmons et al. . |
| 5,645,147 | | 7/1997 | Kovacik et al. . |
| 5,662,193 | * | 9/1997 | Ness . |
| 6,059,081 | * | 5/2000 | Patterson et al. . |
| 6,170,775 | * | 1/2001 | Kovacik et al. . |

* cited by examiner

*Primary Examiner*—William A. Rivera
(74) *Attorney, Agent, or Firm*—MacMillan, Sobanski & Todd, LLC

(57) ABSTRACT

A retracting extension cord reel apparatus includes a cord reel housing for storing an electrical extension cord. A spring motor reel half and a contact reel half form a cord winding surface and are rotatably mounted in the housing on a shaft. A return spring is positioned in a cord winding body of the spring motor reel half for automatically rewinding the extension cord. A brush block is retained in one of two shells forming the housing to maintain brushes in contact with conductive tracks on the contact reel half. The brush block includes an arm for supporting a pigtail extending between the brush block and an exterior of the housing.

14 Claims, 5 Drawing Sheets

RETRACTING EXTENSION CORD REEL

CROSS-REFERENCE TO RELATED APPLICATION

This application is a continuation-in-part application of U.S. patent application Ser. No. 09/325,615, filed Jun. 3, 1999, entitled "Electrical Cord Reel".

BACKGROUND OF THE INVENTION

The present invention relates generally to an electrical extension cord reel. More specifically, the present invention relates to an automatically retracting cord reel configured specifically for use with small appliances, electrical tools and the like which reel can be mounted for use in a specific location and easily removed from its mounting place and used remotely.

Take-up reels for managing the use and storage of electrical extension cords are known. Such reels consist basically of a spool rotatably affixed to a structural component whereby the spool is manually or automatically rotated to wind an extension cord thereabout. Typically, such automatic reels employ a variety of spring and ratchet mechanisms for maintaining the cord in the extended position and rewinding the cord onto the spool when it is no longer needed. Such reels are particularly useful in industrial or commercial settings such as automobile repair shops, machine shops, carpentry shops and construction sites. They permit workers to readily access electrical power as needed for the operation of portable electric tools, test devices, and trouble lights at various locations remote from an existing power outlet. In addition, the use of extension cord reels makes it possible to use only pigtails (i.e., short electrical cords) on the various electrical tools and devices thereby simplifying the movement and storage of the electrical tools and devices themselves.

While exterior designs may vary, retracting electric cord reels basically comprise a spool mounted on a shaft supported for rotation on a bracket or housing, a cooperating ratchet and pawl to arrest the rotation of the spool when the cord has been paid out to a desired length, a spring for rotating the spool in a direction to rewind the cord when the ratchet and pawl are disengaged and an electrical power input means including a commutator connected between a male plug extending from the housing and the extension cord wound on the spool. Such devices are shown, for example, in the U.S. Pat. Nos. 3,619,518; 3,715,526; and 3,808,382.

SUMMARY OF THE INVENTION

The present invention concerns a retracting extension cord reel assembly configured specifically for use with small electrical appliances and tools.

The reel assembly according to the present invention includes a cord reel housing for storing an electrical cord. The cord reel housing has an integrated handle portion that incorporates a pair of opposing posts that permit the housing to be pivotally attached to a mounting bracket. The mounting bracket is adapted to be attached to a generally planar mounting surface, and has means for engaging and disengaging the posts to permit the cord reel housing to be detached from the mounting bracket and hand carried to a location remote from the mounting surface.

The hollow cord reel housing including a right hand shell releasably attached to a left hand shell. A spring motor reel half is positioned in the right hand shell and has a generally tubular cord winding body with an inner end and a radially outwardly extending flange at an outer end thereof. A contact reel half is positioned in the left hand shell and has a generally tubular cord winding body with an inner end and a radially outwardly extending flange at an outer end thereof. The inner ends of the cord winding bodies are attached to provide a reel having a cord winding surface extending between the flanges. A shaft is supported in said housing and the reel halves are mounted on the shaft for rotation of the reel in the housing. A brush block is provided for retaining a plurality of brushes and has an aperture formed therein through which the shaft passes. A brush holder support is formed on the inner surface of the left hand shell for retaining the brush block adjacent the reel and brushes on the brush block in contact with electrically conductive tracks on the contact reel half. A pigtail is connected to the brushes and an extension cord is connected to the tracks.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
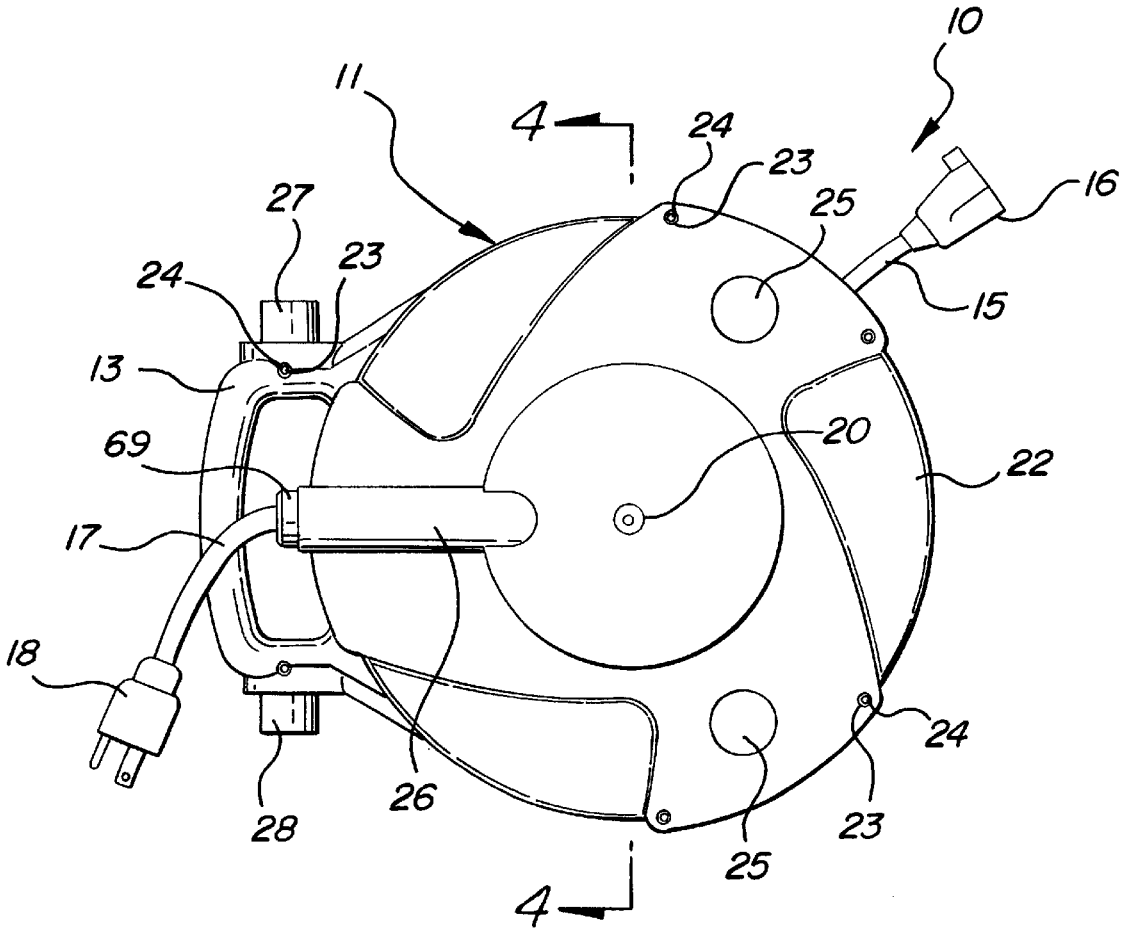
FIG. 1 is a left side elevation view of a retractable cord reel apparatus in accordance with the present invention.
Figure 2:
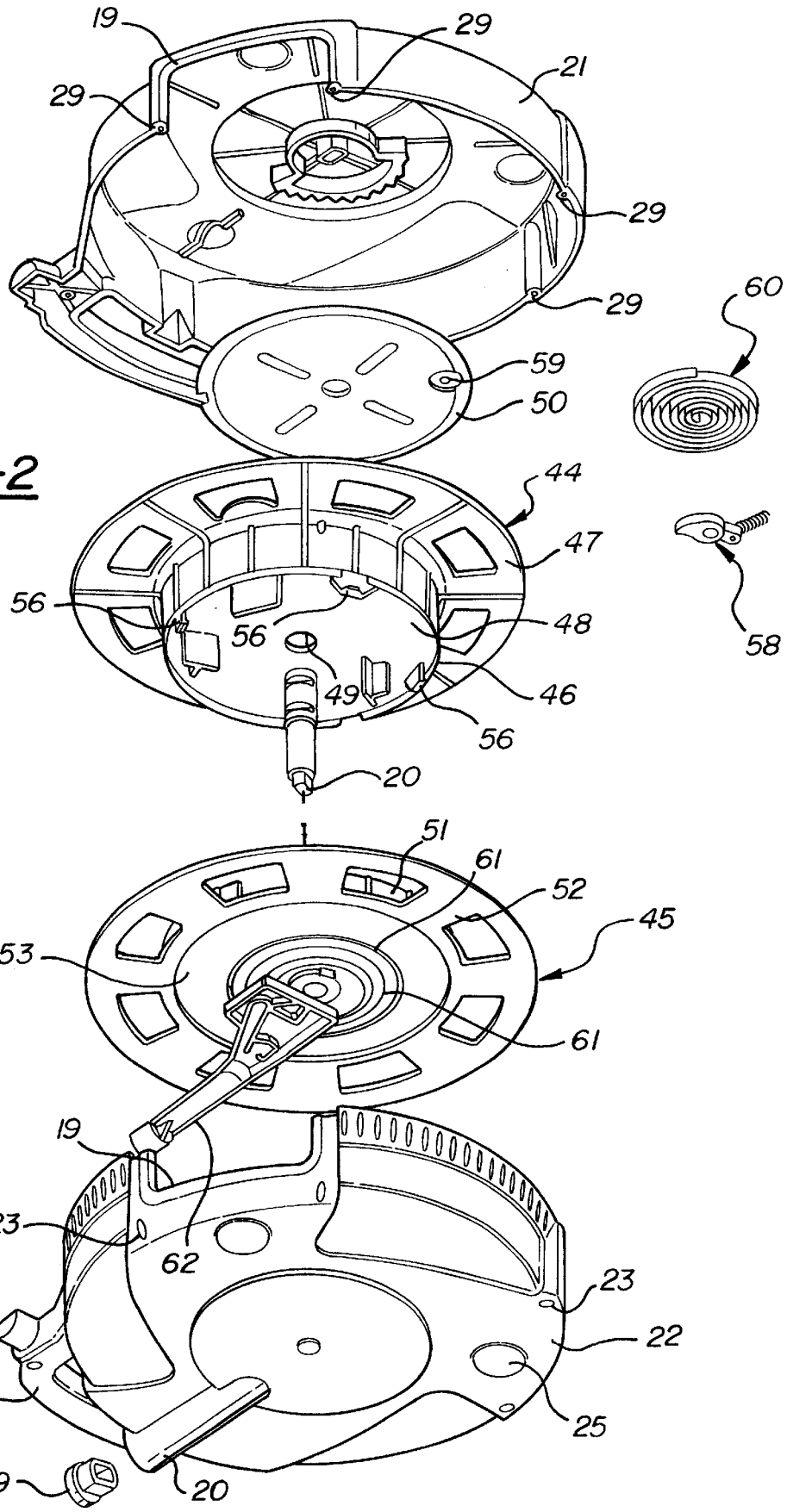
FIG. 2 is an exploded perspective view of the cord reel shown in the FIG. 1.
Figure 3:
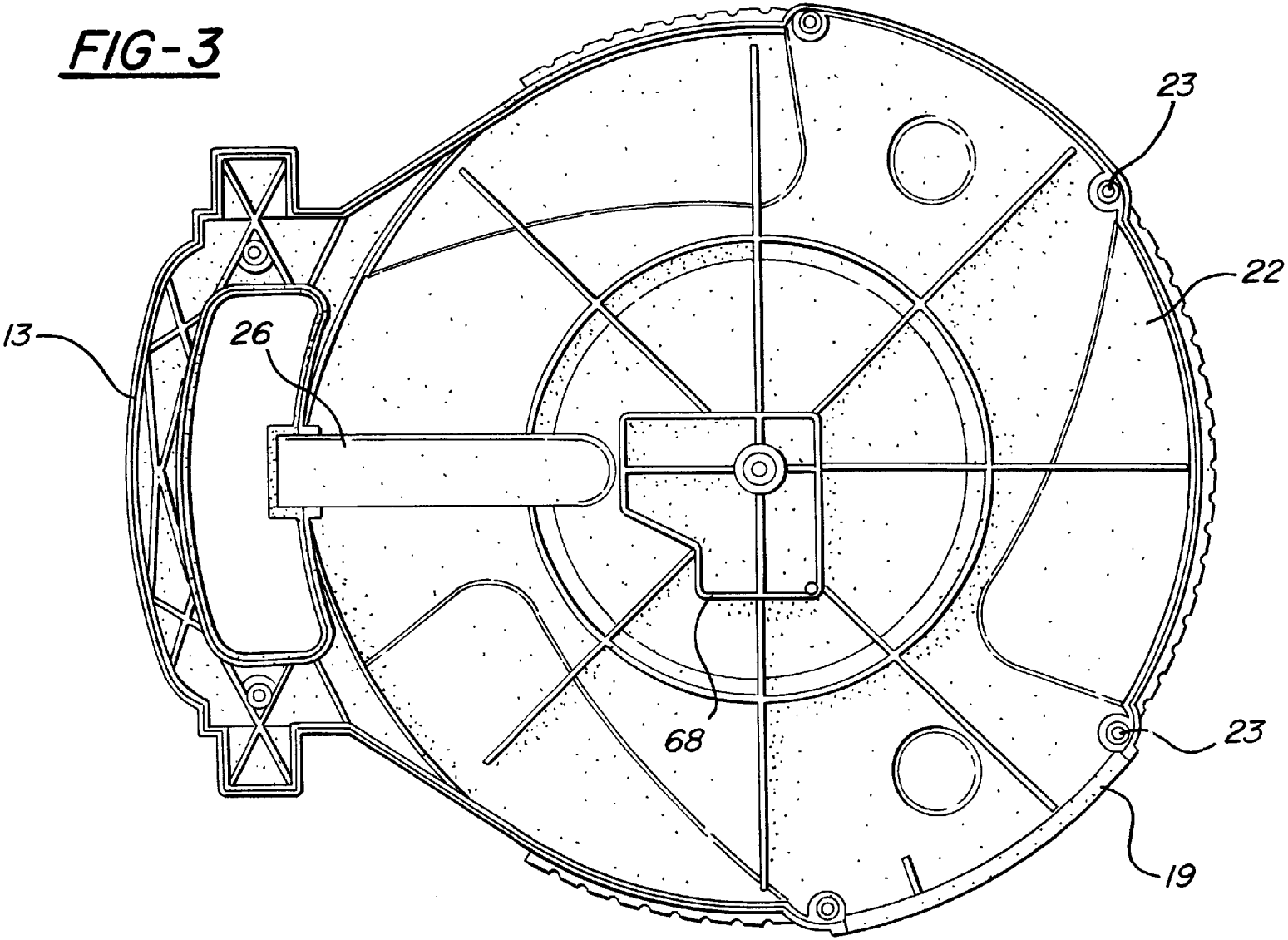
FIG. 3 is an elevation view of the inside of the left hand shell shown in the FIG. 1.
Figure 4:
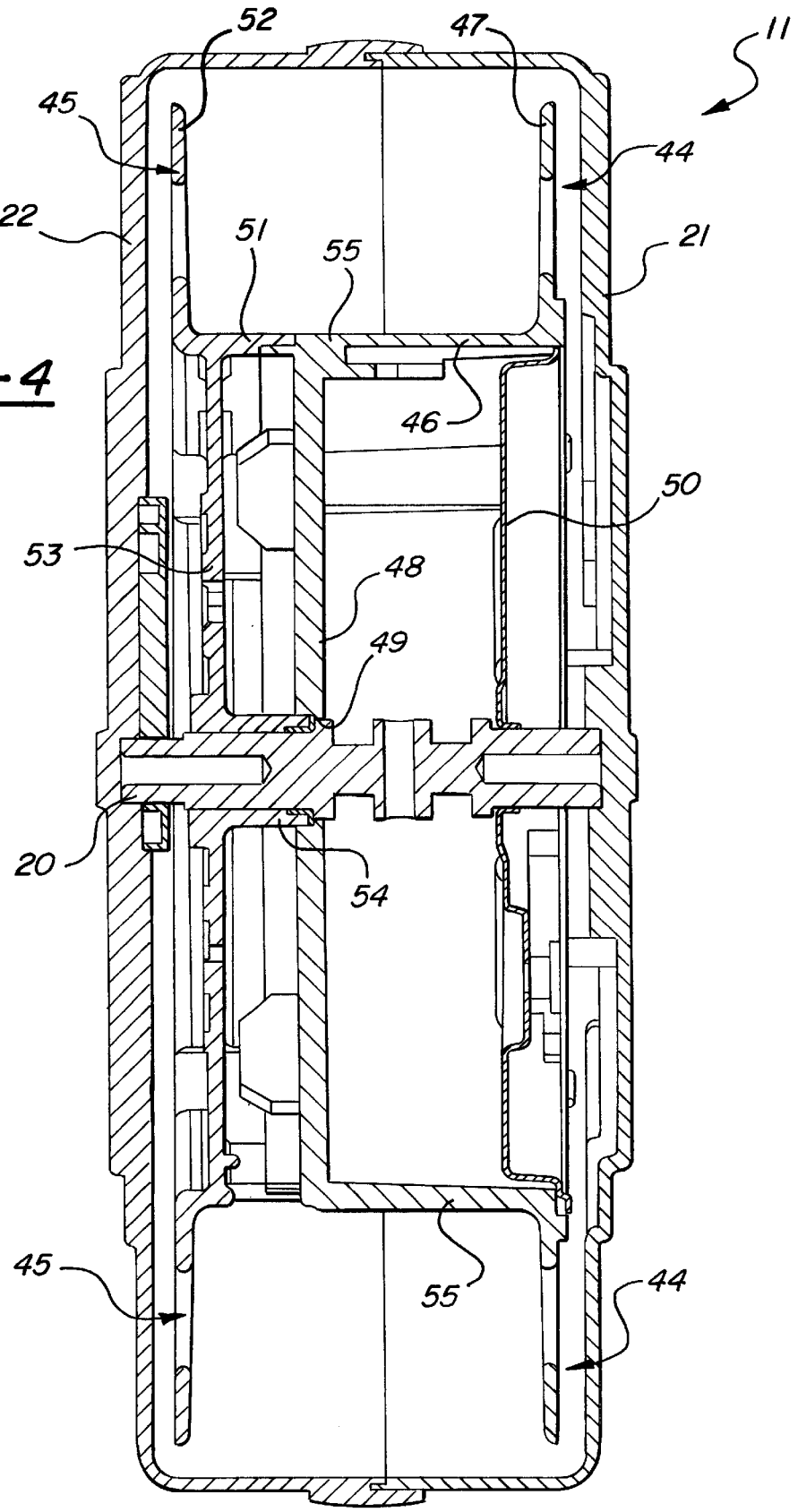
FIG. 4 is a cross-sectional view taken along the line 4—4 in the FIG. 1.

There is shown in the FIGS. 1, 2 and 4 an automatically retracting electrical extension cord reel assembly 10 including a cord reel housing 11 with a handle portion 13 that incorporates a pair of opposing posts 27 and 28 to permit the cord reel housing to be pivotally attached to a mounting bracket (not shown) in a removable manner. The mounting bracket and the method of mounting are described in detail in the U.S. patent application Ser. No. 09/325,615, filed Jun. 3, 1999, entitled "Electrical Cord Reel", which application is incorporated herein by reference.

The cord reel apparatus 10 includes conventional electrical cords for connection between a source of power, such as a wall outlet, and an electrical device to be powered. Such a cord is shown only in the FIG. 1 as a retractable extension cord 15 having a female electrical socket 16 connected to a free end thereof and a fixed pigtail 17 having a male electrical plug 18 connected to a free end thereof. The extension cord 15 extends through an opening 19 formed in the housing 11 and is wound upon a spool or reel (described below) rotatably supported in the housing on a shaft 20. The pigtail 17 is of a length sufficient to reach from the housing 11 to a nearby electrical outlet (not shown). For example, the pigtail 17 can be about fifteen inches long and the plug 18 can be a conventional two prong, polarized type. The electrical connection between the extension cord 15 and the pigtail 17 is made by a conventional commutator (brushes and rings) inside the housing 11.

The housing 11 is formed of a pair of generally cup-shaped shells, a right hand shell 21 and a substantially mirror image left hand shell 22. The shells 21 and 22 are formed of a suitable material such as molded ABS flame-retardant plastic and can be held together by any conventional fastening means. In the FIGS. 1 and 2, the shells 21 and 22 are shown as being retained together by a plurality of screws. The left hand shell 22 has a plurality of apertures 23 formed therein spaced about a periphery thereof. Each of the apertures 23 receives a threaded fastener 24 that threadably engages a corresponding one of a plurality of internal blind holes 29 formed in the interior periphery of the right hand shell 21. The fasteners 24 function as releasable locks holding the shells 21 and 22 together and retaining the shaft 20.

Also present on the exterior of the shells 21 and 22 are a plurality of generally hemispherical supports 25 formed by bumping out portions of the side walls of the shells 21 and 22 at uniformly spaced points adjacent the peripheries thereof. For example, three of the supports 25 are equally spaced on the right hand shell 21 and two of the supports 25 are formed on the left hand shell 22 opposite two of the supports on the right hand shell. An extended portion 26 of the side wall of the left hand shell 22 extends outwardly and radially to form a passage for the pigtail 17 inside the housing 11 and is open at the periphery of the housing to provide an exit for the pigtail. The extended portion 26 is opposite the third support on the right hand shell 21 and also functions as a support. Such supports serve to elevate the cord reel housing 11 above the ground when the housing is used detached from the mounting bracket and placed on one side or the other.

The cord reel housing 11 has the handle portion 13 integrated therein which handle includes the pair of opposing generally cylindrical posts 27 and 28 that permit the cord reel housing 11 to be pivotally attached to the mounting bracket in a removable manner. The integrated handle portion 13 permits the cord reel case to be easily transported to locations remote from the mounting bracket.

The cord reel apparatus 10 according to the present invention can include a resettable circuit breaker (not shown) that is connected between the extension cord 15 and the pigtail 17. Such a circuit breaker may be mounted inside the housing 11 with a reset button exposed at any convenient location.

The mounting bracket and posts 27 and 28 permit the cord reel housing 11 to be mounted in a variety of convenient locations. For example, the cord reel housing could be mounted in a kitchen, workshop, or garage on a vertical wall surface, between upper and lower cabinets and shelves, on the underside of upper cabinets, or inside cabinets. In any of these locations, the housing 11 may be oriented in one position for storage pivoted on the posts 27 and 28 to rest flat against the mounting surface, and in another for use position pivoted away from the mounting surface.

Because the cord reel housing 11 can be easily removed from the mounting bracket, the housing 11 becomes a portable cord reel. When, for example, a worker needs an extension cord at a remote location, the cord reel housing according to the present invention can be unplugged if necessary, removed from the mounting bracket, carried to the desired location, plugged in and used, and then returned to the mounting bracket.

As shown in the FIGS. 2 and 4, the cord reel assembly 10 includes a reel for storing the extension cord 15, permitting the extension cord to be unwound through the opening 19 and automatically rewinding the extension cord. The reel is constructed from a spring motor or right side reel half 44 and a contact or left side reel half 45 mounted on the shaft 20 supported for rotation by the shells 21 and 22. The right side reel half 44 includes a generally tubular cord winding body 46 with a radially outwardly extending flange 47 formed at an outer end thereof. A radially inwardly extending wall 48 is formed at an inner end of the body 46 with a central aperture 49 for accepting the shaft 20. The open outer end of the body 46 is closed by a generally planar cover 50 attached to the reel half 44 by any suitable means such as fasteners or swaging.

The left side reel half 45 also includes a generally tubular cord winding body 51 with a radially outwardly extending flange 52 formed at an outer end thereof. Also at the outer end there is a radially inwardly extending wall 53 with a central aperture in the form of a tube 54 for accepting the shaft 20. The tube 54 extends from the wall 53 into the aperture 49 in the wall 48. The adjacent edges of the bodies 46 and 51 can be configured to overlap as shown to provide a cord winding surface 55 extending between the flanges 47 and 52. A plurality of axially extending locking tabs 56 are formed on the edge of the inner end of the body 46 for cooperation with corresponding slots (not shown) formed in the body 51 to attach the reel halves 44 and 45 together. The reel halves 44 and 45 can be molded from a suitable plastic material.

As shown in the FIG. 2, a ratchet 57 is integrally formed on the inner surface of the right hand shell 21 as an arcuate toothed raised area. The teeth cooperate with a pawl and spring assembly 58 pivotally mounted on the outer surface of the cover 50 at a mounting boss 59 to maintain the extension cord 15 at a desired unwound length. A return spring 60 is provided in the form of a coil of flat spring steel stock that is positioned inside the body 46 and is enclosed by the cover 50. An outer end of the spring 60 is attached to the reel half 44 inside the body 46 and an inner end of the spring is attached to the shaft 20. Thus, as the extension cord 15 is pulled from the housing 1, the reel half 44 will rotate relative to the shaft 20 to wind up the spring 60 which spring then will automatically rewind the cord.

Figure 5:
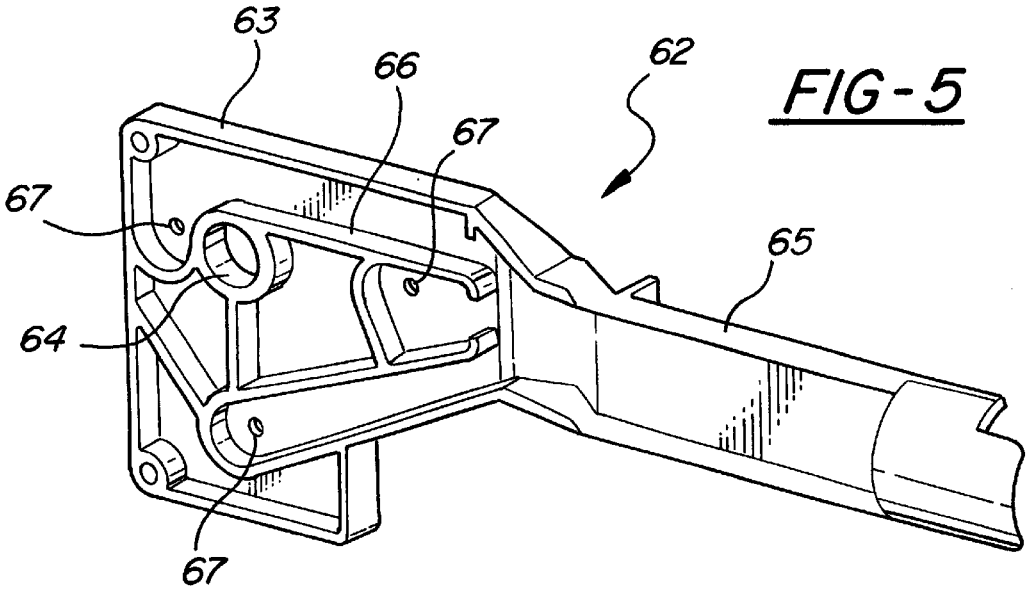
FIG. 5 is a perspective view of the brush block shown in the FIG. 2.

The outer surface of the wall 53 has three concentric electrically conductive tracks 61 formed thereon, each track connected to one of the wires in the extension cord 15 (FIG. 1). As shown in the FIGS. 2 and 5, a brush block 62 is mounted on the inside surface of the left hand shell 22. For example, the brush block 62 can be formed of a suitable nylon material such as "Zytel 101". The brush block 62 has a generally rectangular brush holder portion 63 with an aperture 64 formed therein through which the shaft 20 passes. Extending from the holder portion 63 is an arm 65 that is positioned in the extended portion 26 to carry the fixed pigtail 17. A plurality of inner walls 66 are formed on the outwardly facing surface of the holder portion 63 to separate and guide the three wires (not shown) of the pigtail 17 to apertures 67 formed through the holder portion for connecting the wires to brushes (not shown) mounted on the inwardly facing surface of the holder portion. A brush holder support 68 is formed as an upstanding wall on the inwardly facing surface of the left hand shell 22 in the shape of the holder portion 63 for retaining the brush block inside the wall in position relative to the tracks 61 on the facing surface of the left side reel half 45. The support 68 also is located adjacent to the extended portion 26 through which the pigtail 17 extends. As shown in the FIGS. 1 and 2, a strain relief 69 is positioned in the open end of the extended portion 26 to support the pigtail 17 and relieve strain applied to the pigtail before such strain can reach the electrical connections on the brush block 62.

Figure 6:
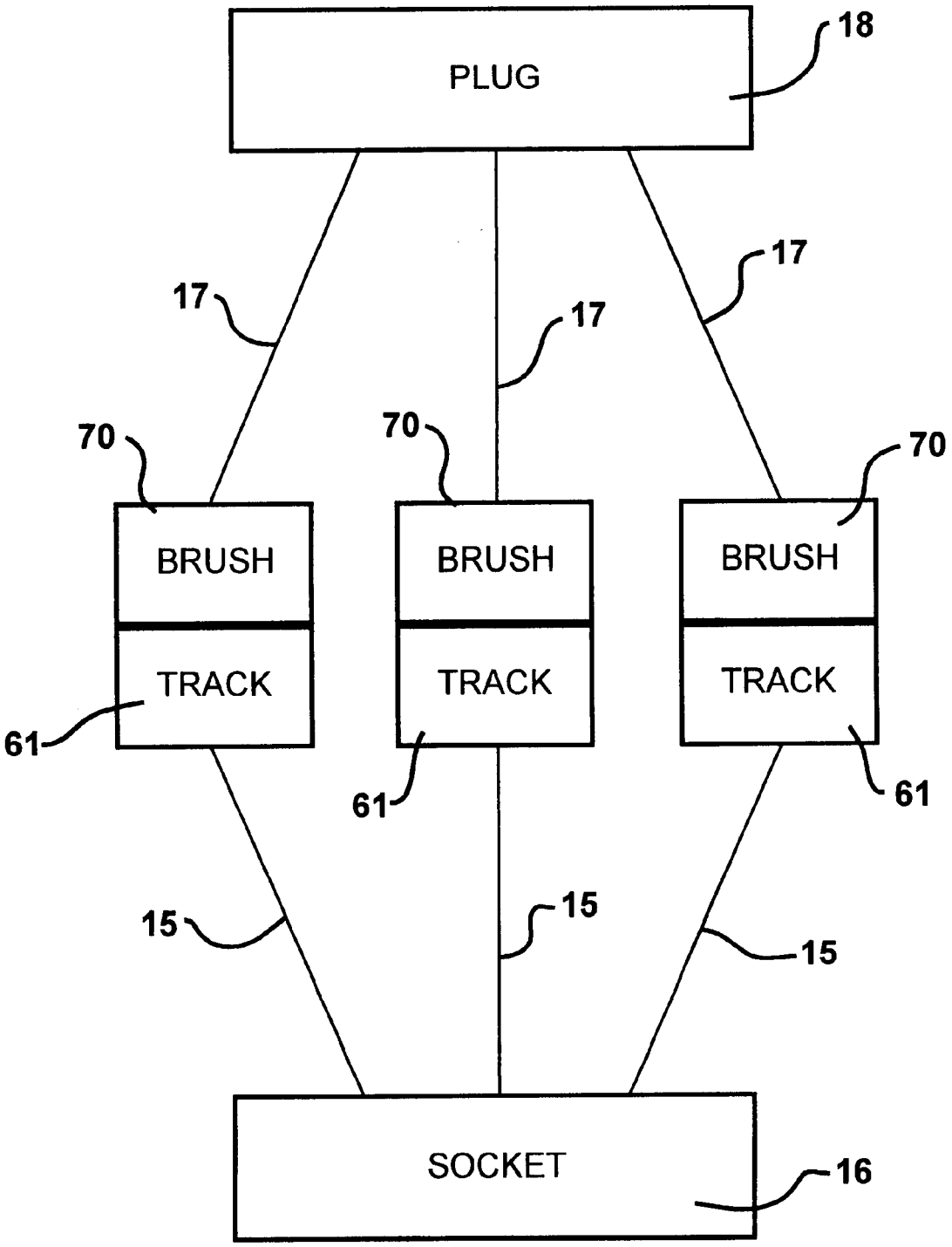
FIG. 6 is a schematic electrical diagram of the apparatus in accordance with the present invention.

FIG. 6 is an electrical schematic diagram of the cord reel assembly 10 showing the female socket 16 connected to each of the three tracks 61 by three separate wires of the extension cord 15. The male plug 18 is connected to each of three brushes 70 by three separate wires of the pigtail 17. As stated above, the brushes 70 are carried by the brush holder portion 63 and maintained in contact with the associated tracks 61.

It can be appreciated that the cord reel assembly 10 is easy to assemble. The shaft 20, the reel halves 44 and 45, the cover 50, the pawl and spring assembly 58, and the return spring 60 are first assembled with the extension cord 15 as a reel subassembly. The brush block 62 is assembled with the brushes and the pigtail 17 as a brush block subassembly. Then the two subassemblies and the shells 21 and 22 are put together and the fasteners 24 are inserted into the apertures 23 to complete the cord reel assembly 10.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An automatically retracting extension cord reel apparatus comprising:

a spring motor reel half formed from a plastic material and having a generally tubular cord winding body with an inner end and a radially outwardly extending flange at an outer end thereof;

a contact reel half formed from a plastic material and having a generally tubular cord winding body with an inner end and a radially outwardly extending flange at an outer end thereof, said inner ends being attached to provide a reel having a cord winding surface extending between said flanges;

a hollow cord reel housing;

a shaft supported in said housing, said reel halves being mounted on said shaft for rotation of said reel in said housing;

a radially inwardly extending wall at said outer end of said contact reel half, said wall having a plurality of concentric electrically conductive tracks formed thereon facing an inside surface of said housing;

a brush block for retaining a plurality of brushes; and a brush holder support on said inner surface of said housing for maintaining said brush block adjacent said tracks.

2. The apparatus according to claim 1 including a return spring positioned in said cord winding body of said spring motor reel half, said return spring having an end attached to said shaft and an opposite end attached to spring motor reel half for rotating said reel in a predetermined direction.

3. The apparatus according to claim 2 including a cover attached to said outer end of said spring motor reel half to enclose said return spring in said cord winding body of said spring motor reel half.

4. The apparatus according to claim 3 including a spring and pawl assembly mounted on said cover, said pawl engaging a ratchet on an inner surface of said housing.

5. The apparatus according to claim 1 wherein said cord reel housing includes a pair of shells, each said shell supporting an associated end of said shaft.

6. The apparatus according to claim 5 wherein each of said shells includes an integrally formed portion of a carrying handle.

7. The apparatus according to claim 1 wherein said brush block includes a brush holder portion having an aperture formed therein through which said shaft passes.

8. The apparatus according to claim 7 wherein said brush holder support includes an upstanding wall on an inner surface of said housing in a shape of said brush holder portion.

9. The apparatus according to claim 1 wherein said brush block includes an arm for carrying a pigtail.

10. The apparatus according to claim 9 wherein said brush block arm is positioned in an extended portion of said housing through which the pigtail can be extended.

11. An automatically retracting extension cord reel apparatus comprising:

a hollow cord reel housing including a right hand shell releasably attached to a left hand shell;

a spring motor reel half positioned in said right hand shell and having a generally tubular cord winding body with an inner end and a radially outwardly extending flange at an outer end thereof;

a contact reel half positioned in said left hand shell and having a generally tubular cord winding body with an inner end and a radially outwardly extending flange at an outer end thereof, said inner ends being attached to provide a reel having a cord winding surface extending between said flanges;

a shaft supported in said housing, said reel halves being mounted on said shaft for rotation of said reel in said housing;

a brush block for retaining a plurality of brushes, said brush block having an aperture formed therein through which said shaft passes; and a brush holder support on said inner surface of said left hand shell for retaining said brush block adjacent said reel.

12. The apparatus according to claim 11 wherein said brush block includes a brush holder portion having said aperture formed therein and said brush holder support includes an upstanding wall on an inner surface of said housing in a shape of said brush holder portion.

13. The apparatus according to claim 11 wherein said brush block includes a brush holder portion having a plurality of walls formed thereon for separating and guiding a plurality of wires in a pigtail.

14. The apparatus according to claim 13 wherein said brush holder portion has a plurality of apertures formed therein for connecting the pigtail wires to brushes.

* * * * *